US009217436B2

(12) United States Patent
Kobayashi et al.

(10) Patent No.: US 9,217,436 B2
(45) Date of Patent: Dec. 22, 2015

(54) IMPELLER FAN ASSEMBLY

(75) Inventors: Sukeyuki Kobayashi, Loves Park, IL (US); Frank Leslie Sincox, III, Rockford, IL (US); Richard George Hext, III, Belvidere, IL (US)

(73) Assignee: GE AVIATION SYSTEMS LLC, Grand Rapids, MI (US)

( * ) Notice: Subject to any disclaimer, the term of this patent is extended or adjusted under 35 U.S.C. 154(b) by 716 days.

(21) Appl. No.: 13/571,466

(22) Filed: Aug. 10, 2012

(65) Prior Publication Data

US 2014/0044524 A1 Feb. 13, 2014

(51) Int. Cl.

| | |
|---|---|
| ***F04D 29/05*** | (2006.01) |
| ***F04D 3/02*** | (2006.01) |
| ***F04D 19/00*** | (2006.01) |
| ***F04D 29/059*** | (2006.01) |
| ***F04D 29/063*** | (2006.01) |

(52) U.S. Cl.

CPC ..... *F04D 3/02* (2013.01); *F04D 19/002* (2013.01); *F04D 29/05* (2013.01); *F04D 29/059* (2013.01); *F04D 29/063* (2013.01)

(58) Field of Classification Search

CPC ..... F04D 29/04; F04D 29/043; F04D 29/05; F04D 29/059; F04D 29/0563; F04D 3/02

See application file for complete search history.

(56) References Cited

U.S. PATENT DOCUMENTS

| | | | | |
|---|---|---|---|---|
| 4,116,592 | A * | 9/1978 | Cherny et al. | 417/423.4 |
| 7,168,926 | B2 | 1/2007 | Manda et al. | |
| 2002/0146315 | A1 * | 10/2002 | Rockwood | 415/111 |

* cited by examiner

*Primary Examiner* — Ninh H Nguyen
*Assistant Examiner* — Jeffrey A Brownson
(74) *Attorney, Agent, or Firm* — General Electric Company; William S. Munnerlyn

(57) ABSTRACT

An impeller fan assembly that includes a housing, a stator, a rotor having a hub and an annular array of non-stationary blades extending from the hub, at least two spaced apart bearings mounted to the stator, and a pump in fluid communication with the bearings to provide fluid to the bearings.

14 Claims, 5 Drawing Sheets

IMPELLER FAN ASSEMBLY

BACKGROUND OF THE INVENTION

Contemporary aircraft include fans used for various cooling purposes, which currently include a configuration having two grease-packed bearings that support a rotating shaft of the fan. Due to a harsh operational environment of high temperature and high rotational speeds, the grease forming the bearing lubricant deteriorates quickly, resulting in relatively frequent maintenance to keep the fan in operating condition. The maintenance is currently done by completely removing at least a portion of the fan from the aircraft.

BRIEF DESCRIPTION OF THE INVENTION

In one embodiment, the invention relates to an impeller fan assembly including a housing having an inner peripheral wall defining a flow through opening, a stator located within the flow through opening and comprising an annular array of stationary blades provided along the inner peripheral wall, a rotor comprising a hub and an annular array of non-stationary blades extending from the hub, at least two spaced apart bearings mounted to the stator, a shaft having a hollow portion rotatably supported by the bearings for rotation about a rotational axis, a sump provided in the stator, and a screw pump provided within the hollow portion of the shaft and having a screw pump inlet fluidly coupled to the sump and a screw pump outlet in fluid communication with the bearings, whereby rotation of the screw pump pumps fluid from the sump to the bearings.

DESCRIPTION OF EMBODIMENTS OF THE INVENTION

Figure 1:
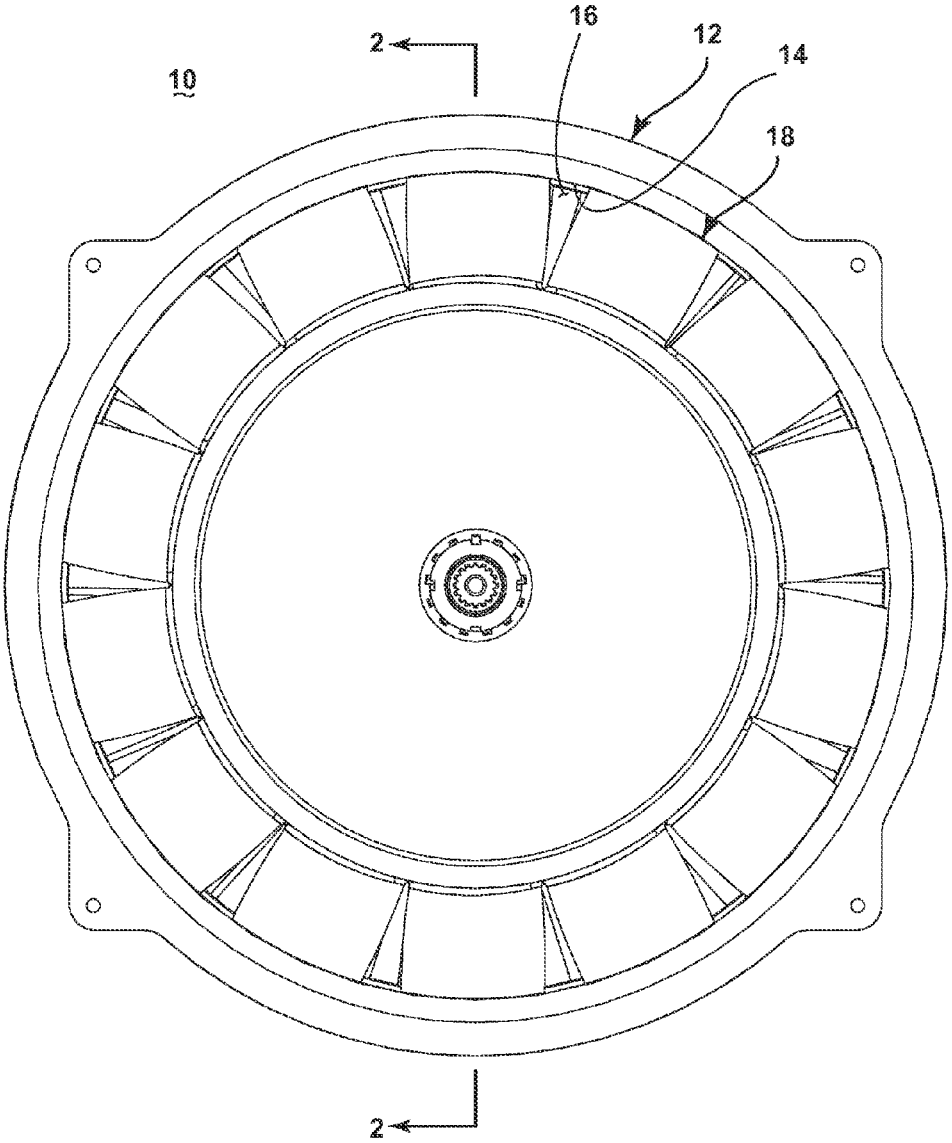
FIG. 1 is a front view of an impeller fan assembly according to an embodiment of the invention.

FIG. 1 illustrates a front view of an impeller fan assembly 10 according to an embodiment of the invention. The impeller fan assembly 10 may be a cooling fan for an aircraft engine or other aircraft application. The impeller fan assembly 10 may be oriented in either a horizontal or vertical orientation, including any angular position between horizontal and vertical. In some applications, the fan assembly 10 may be mounted to the aircraft such that the impeller fan assembly 10 rotates between horizontal and vertical orientations.

A housing 12 including an inner peripheral wall 14 defining a flow through opening 16 may be included in the impeller fan assembly 10. In the illustrated example, the flow of air is left to right through the flow through opening 16. An impeller 18 may be moveably mounted within the housing 12 and a cooling air stream may be generated by the impeller 18 during operation of the impeller fan assembly 10.

Figure 2:
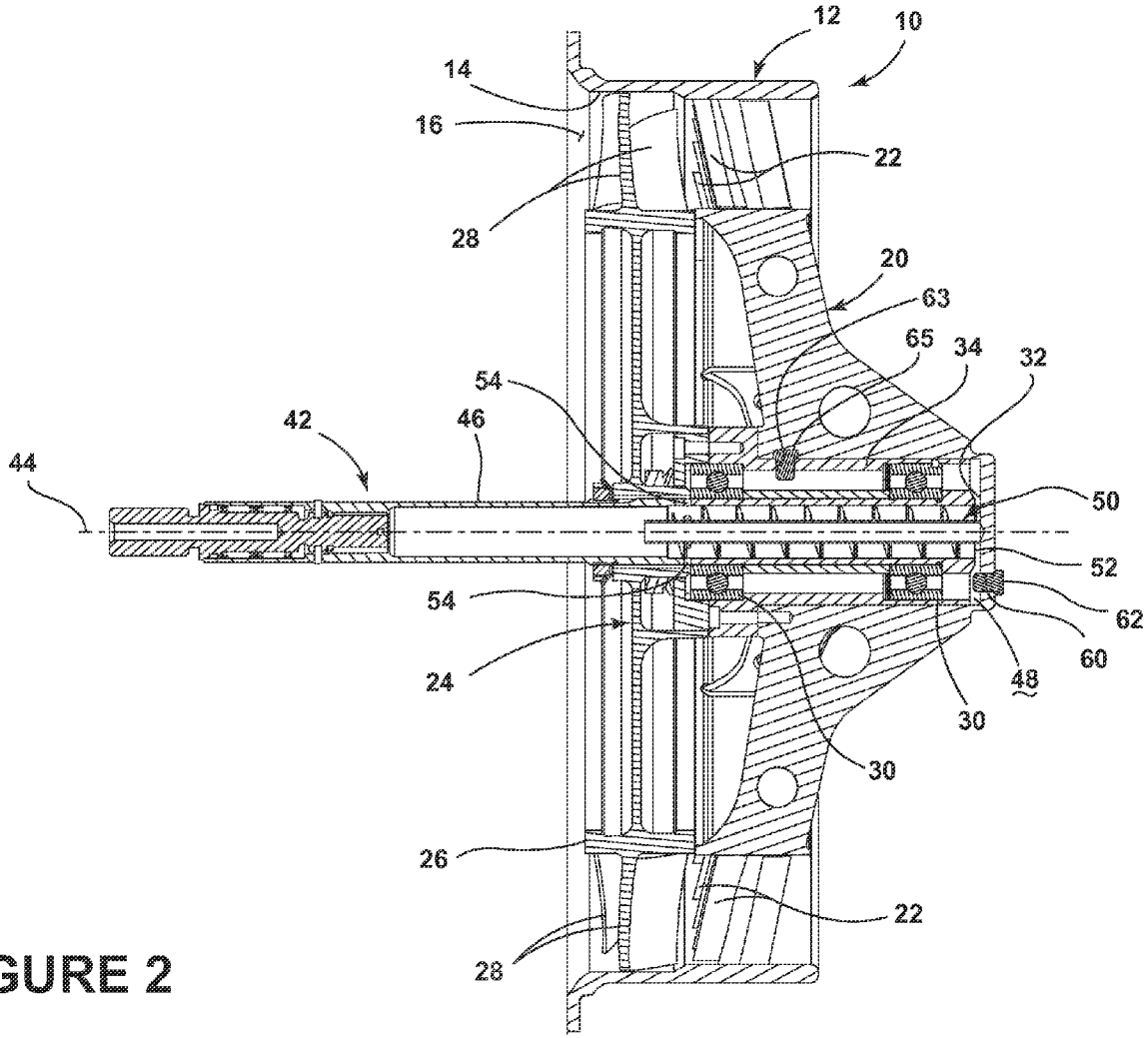
FIG. 2 is a cross-sectional view of the impeller fan assembly of FIG. 1.

FIG. 2 illustrates a partial cross-sectional view of a portion of the impeller fan assembly 10 taken along the line 2-2. A stator 20 may be located within the flow through opening 16 and may include an annular array of stationary blades 22 provided along the inner peripheral wall 14. It is also contemplated that the stator 20 may form a portion of the housing 12. A rotor 24 is also illustrated and includes a hub 26 and an annular array of non-stationary blades 28 extending from the hub 26. Both the stator 20 and rotor 24 form portions of the impeller 18.

At least two spaced apart bearings 30 may be operably mounted to the stator 20. More specifically, the stator 20 has been illustrated as including a recess 32 while a bearing housing 34 mounts the bearings 30 and the bearing housing 34 may be received within the recess 32 of the stator 20. In the illustrated example, two spaced apart bearings 30 have been shown although it will be understood that additional bearings 30 may be included.

A shaft 42 may be rotatably supported by the bearings 30 for rotation about a rotational axis 44. The rotor 24 may be operably coupled to the shaft 42 such that both the shaft 42 and rotor 24 may be co-rotated. The shaft 42 may include a hollow portion 46.

A sump 48 may be provided in the stator 20. In the illustrated example, the bearing housing 34 and a portion of the recess 32 of the stator 20 define the sump 48. A fluid such as oil may be introduced into the sump 48. The sump 48 may span the spaced apart bearings 30 such that when the shaft 42 is oriented such that the rotational axis 44 is horizontal, the bearings 30 are at least partially immersed within the fluid in the sump 48. Further, when the shaft 42 is oriented such that the rotational axis 44 is vertical, at least one of the bearings 30 may not be immersed in the fluid within the sump 48.

The fluid may be circulated by a screw pump 50 to lubricate the bearings 30. More specifically, the screw pump 50 has been illustrated as being provided within the hollow portion 46 of the shaft 42. The screw pump 50 may be coupled to the shaft 42 such that the screw pump 50 co-rotates with the shaft 42.

A screw pump inlet 52 of the screw pump 50 fluidly couples to the sump 48. The screw pump inlet 52 may be located such that when the rotational axis is horizontal, the screw pump inlet 52 is not immersed in the fluid in the sump 48. The screw pump inlet 52 may be located such that when the rotational axis is vertical, the screw pump inlet 52 is immersed in the fluid in the sump 48.

A screw pump outlet 54 may also be in fluid communication with the bearings 30. Several screw pump outlets 54 have been illustrated in the exemplary embodiment. The screw pump outlet 54 may be located such that when the rotational axis 44 is vertical, fluid emitted from the screw pump outlet 54 flows by gravity onto at least one of the bearings 30. In the illustrated example, the screw pump outlet 54 is located above both of the spaced apart bearings 30 such that when the rotational axis 44 is vertical, fluid emitted from the screw pump outlet 54 flows by gravity onto both of the bearings 30.

A fluid access port 60 may be formed in the stator 20 and fluidly coupled to the sump 48. The fluid in the sump 48 may be drained through the fluid access port 60. A plug 62 may be used to close the fluid accesses port 60. Any suitable plug 62 may be used. Further, a second access port 63 may be formed in the bearing housing 34 and fluidly coupled to the sump 48. Fluid may be filled in the sump 48 through the second access port 63. A plug 65 may be included to close the second access port 63.

Figure 3:
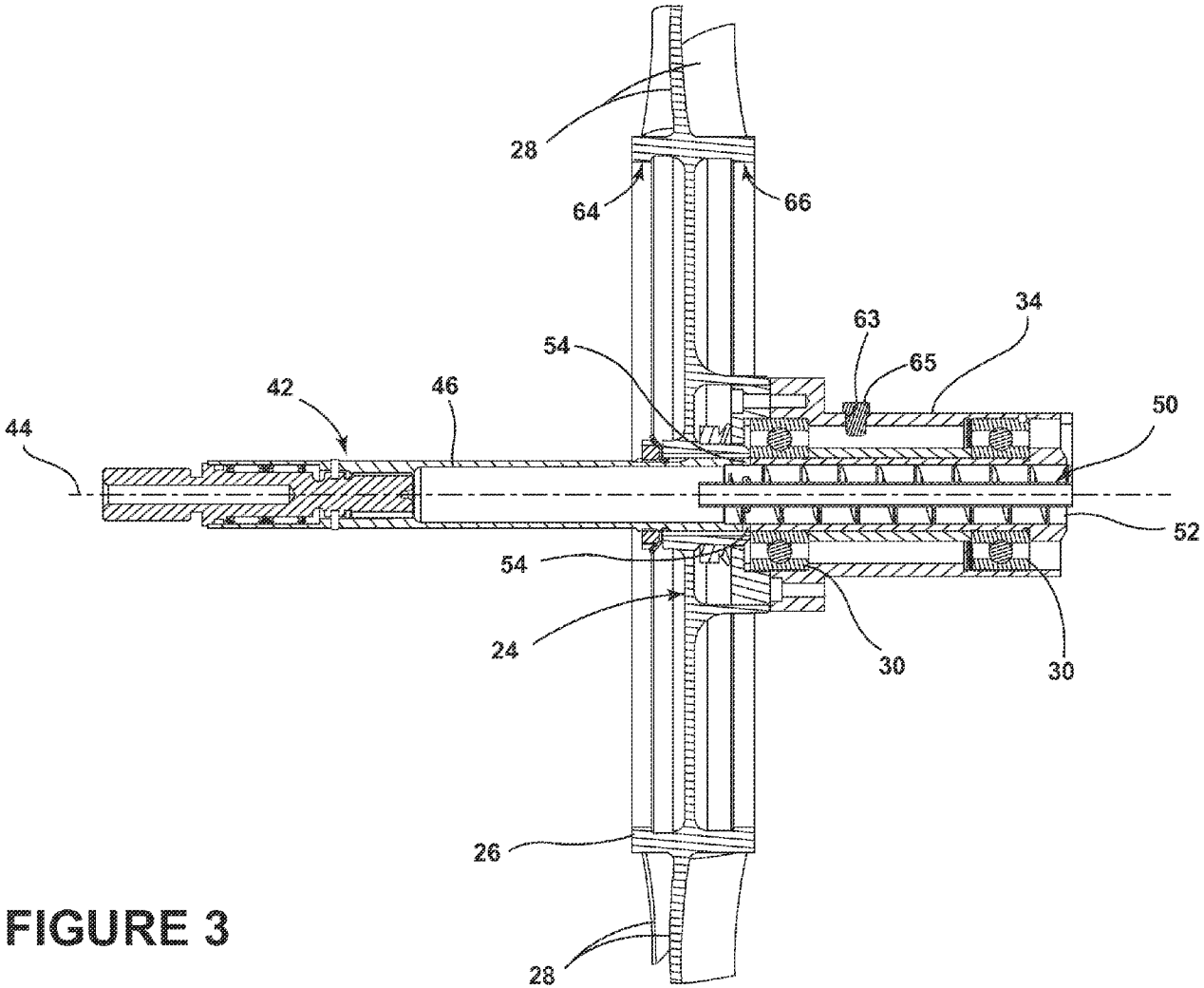
FIG. 3 is an enlarged cross-sectional view of a portion of the impeller fan assembly of FIG. 2.

As more clearly illustrated in FIG. 3, the shaft 42 may be coupled to the bearing housing 34 such that shaft 42, screw pump 50, bearings 30, and bearing housing 34 form a cartridge 63 that can be connected to the stator 20 and the rotor 24. The cartridge 63 has been illustrated as being attached to the rotor 24. The cartridge 63 may be integrated into the impeller fan assembly 10 without causing a weight increase as compared to contemporary configurations. The cartridge 63 makes it possible to balance the sub-assembly at this stage utilizing a front balance plane 64 and a rear balance plane 66. Balance adjustment is not possible with the final assembly, due to inaccessibility to the rear balance plane 66 once the cartridge 63 is mounted to the stator 20.

Figure 4:
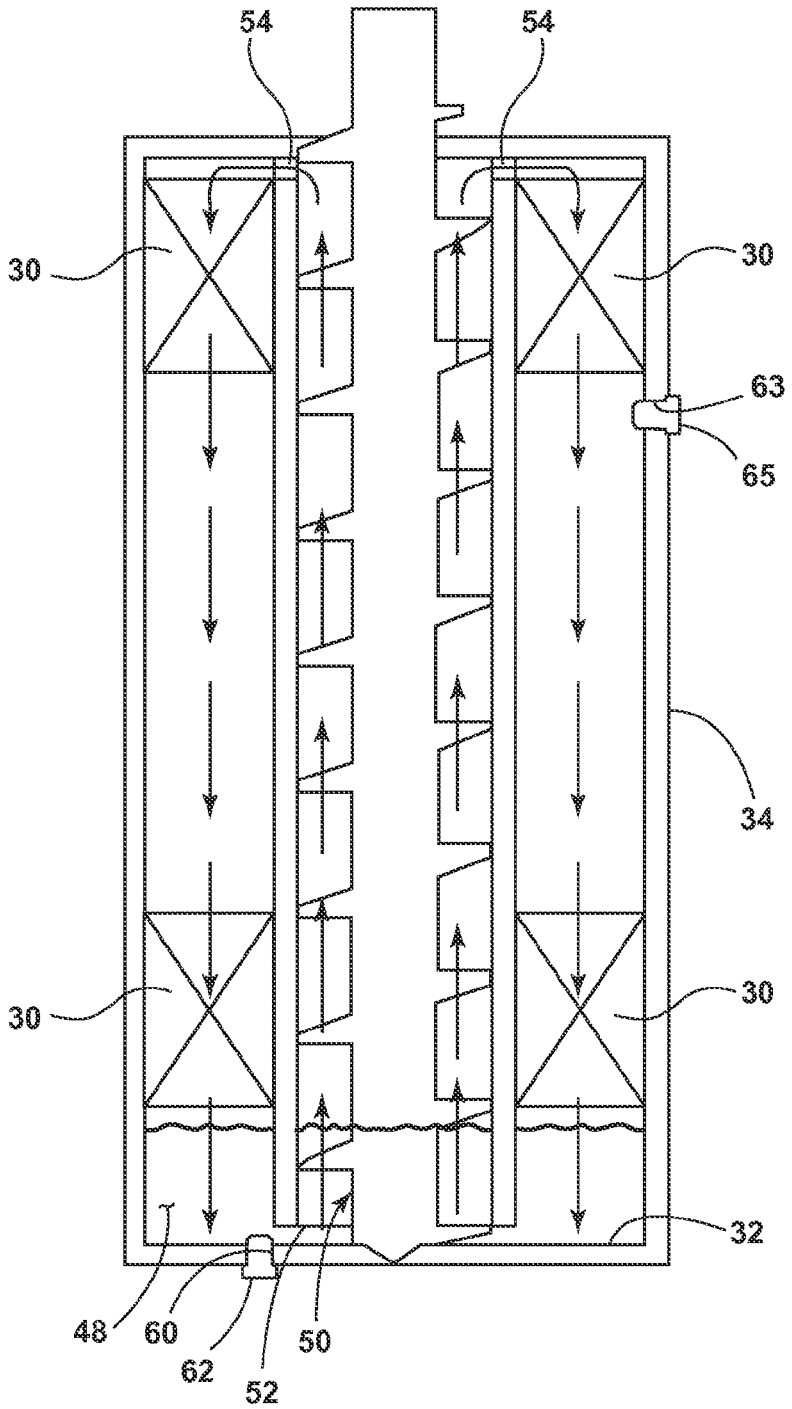
FIG. 4 is a cross-sectional view illustrating fluid movement when the impeller fan assembly of FIG. 1 is in a vertical orientation according to an embodiment of the invention.
Figure 5:
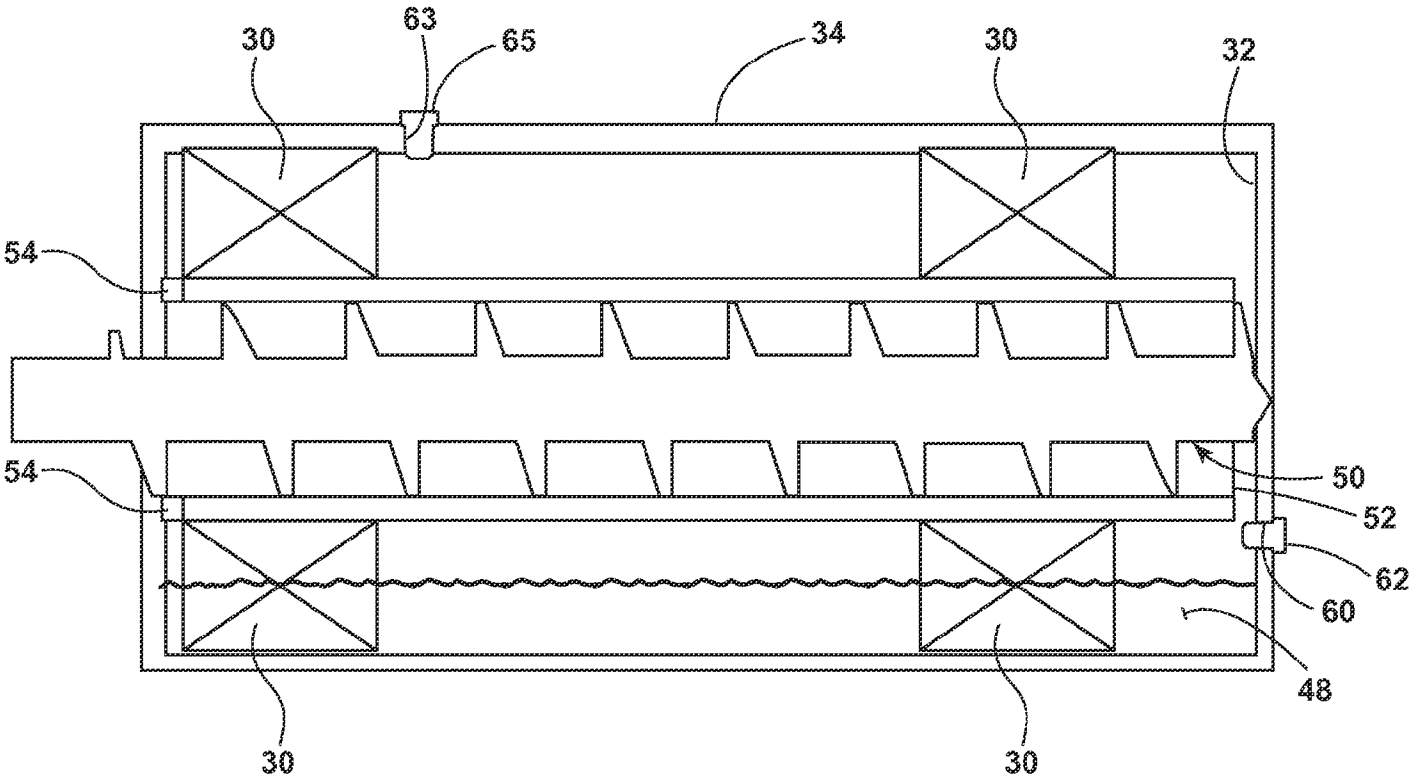
FIG. 5 is a cross-sectional view illustrating bearings partially immersed in fluid when the impeller fan assembly of FIG. 1 is in a horizontal orientation according to an embodiment of the invention.

During operation, rotation of the shaft 42 is utilized to operate the screw pump 50. A quantity of fluid in the sump 48 may be adjusted for both horizontal and vertical orientations of the impeller fan assembly 10. Referring to FIG. 4, when the shaft 42 is in the vertical orientation, the screw pump 50 pumps fluid from the sump 48 through the screw pump outlets 54 to the bearings 30. Fluid emitted from the screw pump outlet 54 flows by gravity onto the bearing 30 and in this manner fluid circulates and lubricates both bearings 30. Referring to FIG. 5, when the shaft 42 is in the horizontal orientation, the bottom part of both bearings 30 is submerged in the fluid located in the sump 48. Rotation of the shaft 42 results in motion of the bearings 30 and evenly wets the bearings 30. In the horizontal orientation, the screw pump 50 is not needed and stays above the fluid pooled in the sump 48. This also results in the impeller fan assembly 10 avoiding unnecessary increase in shaft torque, which would in turn cause increased power consumption.

The embodiments described above provide for a variety of benefits including that they have higher efficiency, high reliability, less maintenance, all-attitude operation, and lower weight. The embodiments described above use a fluid such as oil, in place of grease, for bearing lubrication, and allow the fluid to be changed without removing the impeller fan assembly from the aircraft. This results in a reduced frequency of the removal of the impeller fan assembly and greatly prolongs the service life of the impeller fan assembly, which will result in cost savings, as well as much improved aircraft utilization. The embodiments described above result in easier maintenance and improved fan service life, which results in commercial advantages including reduced maintenance cost and reduced down time of the aircraft on which the impeller fan assembly is installed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An impeller fan assembly comprising:

a housing having an inner peripheral wall defining a flow through opening;

a stator located within the flow through opening and comprising an annular array of stationary blades provided along the inner peripheral wall;

a rotor comprising a hub and an annular array of non-stationary blades extending from the hub;

at least two spaced apart bearings mounted to the stator;

a shaft having a hollow portion rotatably supported by the bearings for rotation about a rotational axis;

a sump provided in the stator; and a screw pump provided within the hollow portion of the shaft and having a screw pump inlet fluidly coupled to the sump and a screw pump outlet in fluid communication with the bearings, whereby rotation of the screw pump pumps fluid from the sump to the bearings, wherein the sump spans the bearings such that when the shaft is oriented such that the rotational axis is horizontal, the bearings are at least partially immersed within the fluid in the sump, and when the shaft is oriented such that the rotational axis is vertical, at least one of the bearings is not immersed in the fluid within the sump.

2. The impeller fan assembly of claim 1 wherein the screw pump inlet is located such that when the rotational axis is horizontal, the screw pump inlet is not immersed in the fluid in the sump.

3. The impeller fan assembly of claim 2 wherein the screw pump inlet is located such that when the rotational axis is vertical, the screw pump inlet is immersed in the fluid in the sump.

4. The impeller fan assembly of claim 3 wherein the screw pump outlet is located such that when the rotational axis is vertical, fluid emitted from the screw pump outlet flows by gravity onto at least one of the bearings.

5. The impeller fan assembly of claim 4 wherein the screw pump outlet is located above the bearings.

6. The impeller fan assembly of claim 1 wherein the screw pump is coupled to the shaft such that the screw pump co-rotates with the shaft.

7. The impeller fan assembly of claim 1, further comprising a fluid access port formed in the stator and fluidly coupled to the sump, whereby the fluid in the sump may be at least filled or drained through the fluid access port.

8. The impeller fan assembly of claim 1, further comprising a bearing housing mounting the bearings, and the stator comprises a recess in which the bearing housing is received.

9. The impeller fan assembly of claim 8 wherein at least a portion of the bearing housing and the recess define the sump.

10. The impeller fan assembly of claim 9 wherein both the bearing housing and the recess define the sump.

11. The impeller fan assembly of claim 9 wherein the screw pump is coupled to the shaft such that the screw co-rotates with the shaft.

12. The impeller fan assembly of claim 11 wherein the shaft is coupled to the bearing housing such that the shaft, screw pump, bearings, and bearing housing form a cartridge that can be connected to the stator.

13. The impeller fan assembly of claim 9, further comprising a fluid access port formed in the bearing housing and fluidly coupled to the sump, whereby the fluid in the sump may be at least filled or drained through the fluid access port.

14. An impeller fan assembly comprising:

a housing having an inner peripheral wall defining a flow through opening;

a stator located within the flow through opening and comprising an annular array of stationary blades provided along the inner peripheral wall;

a rotor comprising a hub and an annular array of non-stationary blades extending from the hub;

at least two spaced apart bearings mounted to the stator;

a shaft having a hollow portion rotatably supported by the bearings for rotation about a rotational axis;

a sump provided in the stator;

a screw pump provided within the hollow portion of the shaft and having a screw pump inlet fluidly coupled to the sump and a screw pump outlet in fluid communication with the bearings, wherein the screw pump is coupled to the shaft such that the screw co-rotates with the shaft, and rotation of the screw pump pumps fluid from the sump to the bearings; and a bearing housing mounting the bearings, wherein the stator comprises a recess in which the bearing housing is received and at least a portion of the bearing housing and the recess define the sump, and the shaft is coupled to the bearing housing such that the shaft, screw pump, bearings, and bearing housing form a cartridge that can be connected to the stator.

* * * * *